US005713068A

United States Patent [19]

Teschendorf et al.

[11] Patent Number: 5,713,068

[45] Date of Patent: Jan. 27, 1998

[54] APPARATUS AND METHOD FOR REMOVING DEVELOPER LIQUID FROM AN IMAGING SUBSTRATE

[75] Inventors: Brian P. Teschendorf; Joseph T. Brophy; W. Blake Kolb; Alberto Goenaga, all of St. Paul, Minn.

[73] Assignee: Minnesota Mining and Manufacturing Company, St. Paul, Minn.

[21] Appl. No.: 811,662

[22] Filed: Mar. 4, 1997

Related U.S. Application Data

[63] Continuation of Ser. No. 536,136, Sep. 29, 1995, abandoned.

[51] Int. Cl.[6] ..... G03G 15/10

[52] U.S. Cl. ..... 399/249; 399/237; 399/239

[58] Field of Search ..... 430/117, 118

[56] References Cited

U.S. PATENT DOCUMENTS

| | | | |
|---|---|---|---|
| Re. 34,437 | 11/1993 | Ariyama et al. | 355/307 |
| 3,654,659 | 4/1972 | Blumenthal | 15/306 A |
| 3,710,469 | 1/1973 | Kitazawa | 29/125 |
| 3,741,643 | 6/1973 | Smith et al. | 355/256 |
| 3,750,246 | 8/1973 | Pessen | 29/130 |
| 3,815,989 | 6/1974 | Davis et al. | 355/256 |
| 3,843,407 | 10/1974 | Thorp | 134/6 |
| 3,850,099 | 11/1974 | Laben | 101/425 |
| 3,910,231 | 10/1975 | Inoue et al. | 118/637 |
| 3,940,282 | 2/1976 | Hwa | 134/6 |
| 3,955,533 | 5/1976 | Smith et al. | 118/652 |
| 4,181,094 | 1/1980 | Gardiner . | |
| 4,325,627 | 4/1982 | Swidler et al. | 355/256 |
| 4,395,113 | 7/1983 | Buchan et al. | 355/297 |
| 4,416,201 | 11/1983 | Kessler | 101/348 |
| 4,436,054 | 3/1984 | Ceelen et al. | 118/652 |
| 4,482,242 | 11/1984 | Moraw et al. | 355/10 |

(List continued on next page.)

FOREIGN PATENT DOCUMENTS

| | | |
|---|---|---|
| 0 575 698 | 12/1993 | European Pat. Off. . |
| 0 657 786 A1 | 6/1995 | European Pat. Off. . |
| 53-22435 | 3/1978 | Japan . |
| 55-015190 | 2/1980 | Japan . |
| 60-060678 | 8/1985 | Japan . |
| 4-69680 | 4/1992 | Japan . |
| 5-19634 | 1/1993 | Japan . |
| 05019634 | 6/1993 | Japan . |
| 05027653 | 6/1993 | Japan . |
| 6-95472 | 8/1994 | Japan . |
| 1 579 405 | 11/1980 | United Kingdom . |

OTHER PUBLICATIONS

IBM Technical Disclosure Bulletin, Jun. 1984, US, vol. 27, pp. 170–171, Uniform Pressure Roll.

*Primary Examiner*—Matthew S. Smith
*Attorney, Agent, or Firm*—William D. Bauer

[57] ABSTRACT

An apparatus and method for removing excess developer liquid from an imaging substrate make use of a squeegee roller, and a mechanism for loading the squeegee roller against the imaging substrate. The squeegee roller removes the excess developer liquid from the imaging substrate at an upstream side of the squeegee roller relative to a direction of movement of the imaging substrate. A portion of the excess developer liquid can pass to a downstream side of the squeegee roller, however, and be transferred from the squeegee roller to the imaging substrate. A second developer liquid removal mechanism is provided to remove from the imaging substrate the portion of the excess developer liquid transferred from the squeegee roller. The second developer liquid removal mechanism may include a second squeegee roller mounted at a position adjacent the downstream side of the first squeegee roller. The second squeegee roller can include first and second squeegee sections that contact the imaging substrate at positions outside of the imaging region. The second squeegee roller can be driven in a direction opposite to the direction of movement of the imaging substrate to effectively remove the excess developer liquid.

44 Claims, 3 Drawing Sheets

U.S. PATENT DOCUMENTS 4,627,705 12/1986 Landa et al. ..... 355/326 R
4,640,605 2/1987 Ariyama et al. ..... 355/327
4,669,859 6/1987 Mochizuki et al. ..... 355/246
4,682,881 7/1987 Komatsubara et al. ..... 355/296
4,728,987 3/1988 Diola et al. ..... 355/245
4,801,965 1/1989 Mochizuki et al. ..... 355/206
4,905,047 2/1990 Ariyama ..... 355/256
4,935,788 6/1990 Fantuzzo et al. ..... 355/326
4,956,211 9/1990 Saito ..... 428/36.5
4,990,962 2/1991 Kishi .
5,021,834 6/1991 Tsuruoka et al. ..... 355/256
5,092,235 3/1992 Rise ..... 100/168
5,122,839 6/1992 Siegel et al. .
5,155,534 10/1992 Kurotori et al. ..... 355/256
5,195,430 3/1993 Rise ..... 100/168
5,220,384 6/1993 Landa et al. ..... 355/256
5,221,944 6/1993 Yoda et al. ..... 355/256
5,262,259 11/1993 Chou et al. ..... 430/47
5,289,238 2/1994 Lior et al. ..... 355/256
5,300,990 4/1994 Thompson ..... 355/256
5,359,398 10/1994 Echigo et al. ..... 355/256
5,369,477 11/1994 Foote et al. ..... 355/256
5,374,980 12/1994 Kubo et al. ..... 355/256
5,384,225 1/1995 Kurotori et al. ..... 355/256 X
5,420,675 5/1995 Thompson ..... 355/256
5,420,676 5/1995 Arcaro .
5,432,591 7/1995 Geleynse ..... 355/256
5,463,453 10/1995 Kurotori et al. ..... 355/256
5,576,815 11/1996 Teschendorf et al. .

APPARATUS AND METHOD FOR REMOVING DEVELOPER LIQUID FROM AN IMAGING SUBSTRATE

This is a continuation of application Ser. No. 08/536,136 filed Sep. 29, 1995 now abandoned.

FIELD OF THE INVENTION

The present invention relates generally to liquid electrographic imaging technology and, more particularly, to techniques for removing developer liquid from an imaging substrate in a liquid electrographic imaging system.

DISCUSSION OF RELATED ART

A liquid electrographic imaging system includes an imaging substrate onto which a developer liquid is delivered to develop a latent image. A liquid electrographic imaging system may comprise as the imaging substrate a dielectric or a photoreceptor. A photoreceptor includes a photoconductive material. A latent image can be formed on a photoreceptor by selectively discharging the photoreceptor with a pattern of radiation, whereas a latent image can be formed on a dielectric by selectively discharging the dielectric with an electrostatic stylus. A liquid electrophotographic imaging system will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrographic imaging system.

The erasure station exposes the photoreceptor to erase radiation sufficient to uniformly discharge any electrostatic charge remaining from a previous imaging operation. The charging station electrostatically charges the surface of the photoreceptor. The exposure station selectively discharges the surface of the photoreceptor to form a latent electrostatic image. A multi-color imaging system may include several exposure stations that form a plurality of latent images. Each of the latent images in a multi-color imaging system is representative of one of a plurality of color separation images for an original multi-color image to be reproduced.

As a latent image is formed, the development station delivers developer liquid to the photoreceptor via a development roller to develop the latent image. In a multi-color imaging system, each of a plurality of development stations applies an appropriately colored developer liquid to the photoreceptor to form an intermediate representation of the corresponding color separation image. The drying station dries the developer liquid applied by the development station or stations. The transfer station then transfers the developer liquid applied by the development stations from the photoreceptor to an output substrate, such as a sheet of paper or film, to form a visible representation of the original image.

A development station typically includes a development device, such as a development roller or belt, and a squeegee roller. Use of a development roller will be discussed for purposes of example. A development roller is rotated by a drive mechanism, whereas the squeegee roller typically is passively driven by the photoreceptor. The biased, rotating development roller applies developer liquid to the surface of an imaging region of the photoreceptor to develop the latent image. The squeegee roller removes excess developer liquid from the photoreceptor to partially dry the developed image prior to application of the drying and transfer stations to the photoreceptor. The squeegee roller is loaded against the photoreceptor to form a nip that prevents excess developer liquid from passing downstream with the photoreceptor. The photoreceptor can be supported at the nip by a backup roller. The squeegee roller ordinarily comprises an elastomeric material mounted about a core. The elastomeric material provides generally uniform pressure along the nip. In operation, the excess developer liquid removed from the photoreceptor forms a hold-up volume on the upstream side of the nip.

The squeegee roller generally is effective in removing excess developer liquid from the photoreceptor. During prolonged imaging sequences, however, the amount of developer liquid in the hold-up volume of the squeegee roller nip increases. Competing hydrodynamic forces govern the flow and distribution of developer liquid in the squeegee roller nip. For example, gravity forces pull the developer liquid downward along the outer surface of the squeegee roller and out of the nip. Viscous forces resulting from movement of the squeegee roller and photoreceptor oppose the gravity forces, retaining the developer liquid in the nip. For a wetting liquid, the maximum amount of liquid that can be held in the squeegee roller nip is ultimately determined by the balance between viscous forces and gravity forces.

Capillary or surface forces in the nip cusp act to draw the developer liquid laterally outward toward opposite ends of the squeegee roller. Regions of the squeegee roller at the opposite ends are outside of the imaging region of the photoreceptor, and therefore are substantially free of developer liquid. As the imaging sequence progresses, however, the developer liquid reaches the dry end regions and is sucked, or "wrapped," around the squeegee roller to the downstream side. The movement of developer liquid to the downstream side is sometimes referred to as "developer liquid wrap-around." Gradually, the developer liquid migrates laterally toward the center of the squeegee roller. A balance between capillary and hydrodynamic forces on the downstream side of the squeegee roller limits the advancement of the wrap-around developer liquid toward the center of the squeegee roller.

The wrap-around developer liquid creates a band of developer liquid on the downstream side of the squeegee roller. The squeegee roller transfers the band of developer liquid to the photoreceptor. The band of developer liquid is undesirable because it can produce excess developer liquid in the margins of the printed page, adversely affecting image quality. The wrap-around developer liquid also can result in contamination of differently colored developer liquids and components with a multi-color imaging system. Further, the wrap-around developer liquid cannot be reclaimed for use by the imaging system, resulting in excessive developer liquid consumption.

In view of the image quality, developer liquid contamination, and developer liquid consumption concerns raised by the developer liquid wrap-around problem described above, there is a need for an improved squeegee apparatus. In particular, there is a need for a squeegee apparatus capable of eliminating the above problems caused by developer liquid wrap-around.

SUMMARY OF THE INVENTION

The present invention is directed to a squeegee apparatus and method for removing excess developer liquid from an imaging substrate in a liquid electrographic imaging system.

The present invention also is directed to an imaging system that makes use of such a squeegee apparatus and method. The squeegee apparatus and method of the present invention operate to remove from the imaging substrate excess developer liquid caused by developer liquid wrap-around. The squeegee apparatus and method thereby enhance image quality, prevent developer liquid contamination, and reduce developer liquid consumption within the imaging system.

A squeegee apparatus, in accordance with a first embodiment of the present invention, comprises a first developer liquid removal mechanism including a squeegee roller, and means for loading the squeegee roller against the imaging substrate, the squeegee roller removing the excess developer liquid from the imaging substrate at an upstream side of the squeegee roller relative to a direction of movement of the imaging substrate, wherein a portion of the excess developer liquid passes to a downstream side of the squeegee roller, the portion of the excess developer liquid being transferred from the squeegee roller to the imaging substrate, and a second developer liquid removal mechanism for removing from the imaging substrate the portion of the excess developer liquid transferred from the squeegee roller.

A squeegee apparatus, in accordance with a second embodiment of the present invention, comprises a first squeegee roller, means for loading the first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate, a second squeegee roller, means for loading the second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate, a drive mechanism for driving the second squeegee roller in a direction opposite to the direction of movement of the imaging substrate, and means for removing a portion of the excess developer liquid from the first squeegee section and the second squeegee section.

A squeegee method, in accordance with a third embodiment of the present invention, comprises the steps of loading a squeegee roller against the imaging substrate, the squeegee roller removing the excess developer liquid from the imaging substrate at an upstream side of the squeegee roller relative to a direction of movement of the imaging substrate, wherein a portion of the excess developer liquid passes to a downstream side of the squeegee roller, the portion of the excess developer liquid being transferred from the squeegee roller to the imaging substrate, and removing from the imaging substrate the portion of the excess developer liquid transferred from the squeegee roller.

A squeegee method, in accordance with a fourth embodiment of the present invention, comprises the steps of loading a first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate, loading a second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate, driving the second squeegee roller in a direction opposite to the direction of movement of the imaging substrate, and removing a portion of the excess developer liquid from the first squeegee section and the second squeegee section.

An imaging system, in accordance with a fifth embodiment of the present invention, comprises an imaging substrate, means for moving the imaging substrate in a first direction, means for forming a latent electrostatic image on an imaging region of the imaging substrate, a development station for delivering developer liquid to the imaging region of the imaging substrate to develop the latent electrostatic image, a squeegee apparatus for removing excess developer liquid from the imaging substrate, the squeegee apparatus comprising a first developer liquid removal mechanism including a squeegee roller, and means for loading the squeegee roller against the imaging substrate, the squeegee roller removing the excess developer liquid from the imaging substrate at an upstream side of the squeegee roller relative to a direction of movement of the imaging substrate, wherein a portion of the excess developer liquid passes to a downstream side of the squeegee roller, the portion of the excess developer liquid being transferred from the squeegee roller to the imaging substrate, and a second developer liquid removal mechanism for removing from the imaging substrate the portion of the excess developer liquid transferred from the squeegee roller, and means for transferring the developer liquid remaining on the imaging region of the imaging substrate to an imaging substrate, thereby forming a visible representation of an image.

An imaging system, in accordance with a sixth embodiment of the present invention, comprises an imaging substrate, means for moving the imaging substrate in a first direction, means for forming a latent electrostatic image on the imaging region of the imaging substrate, a development station for delivering developer liquid to the imaging region of the imaging substrate to develop the latent electrostatic image, a squeegee apparatus for removing excess developer liquid from the imaging substrate, the squeegee apparatus comprising a first squeegee roller, means for loading the first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate, a second squeegee roller, means for loading the second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate, a drive mechanism for driving the second squeegee roller in a direction opposite to the direction of movement of the imaging substrate, and means for removing a portion of the excess developer liquid from the first squeegee section and the second squeegee section, and means for transferring the developer liquid remaining on the imaging region of the imaging substrate to an imaging substrate, thereby forming a visible representation of an image.

The advantages of the present invention will be set forth in part in the description that follows, and in part will be apparent from the description, or may be learned by practice of the present invention. The advantages of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
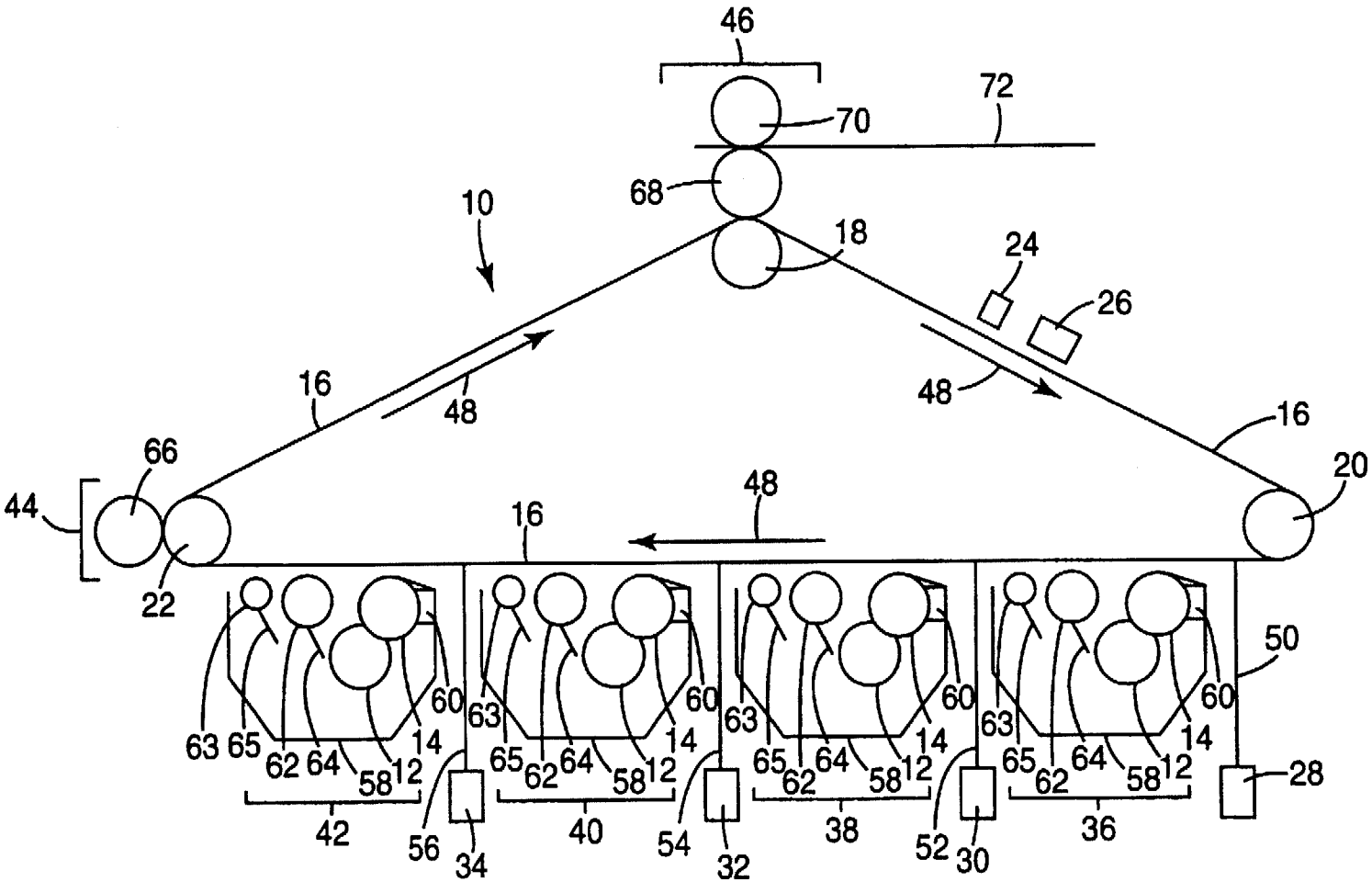
FIG. 1 is a side view of an exemplary liquid electrographic imaging system.

FIG. 1 is a schematic diagram of an exemplary liquid electrographic imaging system 10 incorporating a squeegee apparatus, in accordance with the present invention. As shown in FIG. 1, the squeegee apparatus may include a first squeegee roller 12 and a second squeegee roller 14. The squeegee apparatus can be mounted, for example, adjacent a development device, such as development roller 15, in a development station. The squeegee apparatus will be described in detail later in this description. In FIG. 1, system 10 is an electrophotographic imaging system having a photoreceptor 16 as an imaging substrate. The system 10 is configured to form a multi-color image in a single pass of a photoreceptor 16 associated with the system. The single-pass system 10 enables multi-color images to be assembled at extremely high speeds. An example of a liquid electrophotographic imaging system configured to assemble a multi-color image in a single pass of a photoreceptor is disclosed in copending and commonly assigned United States patent application Ser. No. 08/537,296, filed Sep. 29, 1995, entitled "METHOD AND APPARATUS FOR PRODUCING A MULTI-COLORED IN AN ELECTROPHOTOGRAPHIC SYSTEM." The entire content of the above-referenced patent application is incorporated herein by reference.

Although imaging system 10 is shown as a multi-color/single-pass system in FIG. 1, the squeegee apparatus of the present invention can be readily applied to remove excess developer liquid from a photoreceptor in both single-color liquid electrographic imaging systems and multi-color/multi-pass liquid electrographic imaging systems. In addition, the squeegee apparatus of the present invention can be readily applied to remove developer liquid in systems in which the photoreceptor is configured as a photoreceptor belt, a photoreceptor drum, or a photoreceptor sheet. Similarly, the squeegee apparatus of the present invention can be applied to remove developer liquid in multi-color/multi-pass, multi-color/single-pass, or single-color electrographic systems incorporating a dielectric belt, drum, or sheet as the imaging substrate. Therefore, incorporation of the apparatus of the present invention in the particular multi-color, single-pass electrophotographic imaging system 10 of FIG. 1 should be considered exemplary only.

As shown in FIG. 1, imaging system 10 includes a photoreceptor 16 in the form of a continuous photoreceptor belt mounted about first, second, and third belt rollers 18, 20, 22, an erasure station 24, a charging station 26, a plurality of exposure stations 28, 30, 32, 34, a plurality of development stations 36, 38, 40, 42, a drying station 44, and a transfer station 46. In operation of system 10, photoreceptor 16 is moved to travel in a first direction indicated by arrows 48. The photoreceptor 16 can be moved, for example, by activating a motor coupled to a rotor shaft associated with one of belt rollers 18, 20, 22. As photoreceptor 16 moves in first direction 48, erasure station 24 exposes the photoreceptor to erase radiation to uniformly discharge any electrostatic charge remaining from a previous imaging operation. The charging station 26 then charges the surface of photoreceptor 16 to a predetermined level.

The exposure stations 28, 30, 32, 34 emit beams 50, 52, 54, 56 of radiation that selectively discharge an imaging region of the charged photoreceptor 16 in an imagewise pattern to form a latent electrostatic image. Each of exposure stations 28, 30, 32, 34 may comprise, for example, a scanning laser module. For multi-color imaging, each of exposure stations 28, 30, 32, 34 forms a latent image representative of one of a plurality of color separation images of an original image to be reproduced. The combination of the color separation images produces an overall multi-color representation of the original image. The exposure stations 28, 30, 32, 34 emit radiation beams 50, 52, 54, 56, respectively, to form latent images in the same imaging region of photoreceptor 16. Thus, each of exposure stations 28, 30, 32, 34 forms a latent image on photoreceptor 16 as the imaging region passes the respective exposure station.

As further shown in FIG. 1, each of development stations 36, 38, 40, 42 may include first squeegee roller 12, second squeegee roller 14, a development device such as development roller 15, a developer liquid recovery reservoir 58, a plenum 60 for delivering developer liquid to the development roller, a cleaning roller 62 for removing developer liquid from the development roller, a blade mechanism 64 for removing developer liquid from first squeegee roller 12, and a blade mechanism 74 for removing developer liquid from second squeegee roller 14. An example of a suitable development station is disclosed in copending and commonly assigned U.S. patent application Ser. No. 08/536,135, filed Sep. 29, 1995, entitled "DEVELOPMENT APPARATUS FOR A LIQUID ELECTROGRAPHIC IMAGING SYSTEM." The entire content of the above-referenced patent application is incorporated herein by reference.

The development roller 15 is in fluid communication, via plenum 60, with a source of one of a plurality of differently colored developer liquids corresponding to the particular color separation to be developed. The developer liquid can be pumped from the source to plenum 60 for application to the surface of development roller 15. Alternatively, the surface of development roller 15 could be placed in contact with the source of developer liquid, or with another roller delivering developer liquid, eliminating the need for a pump and plenum 60. The differently colored developer liquids may correspond, for example, to cyan, magenta, yellow, and black color separations.

In this description, the term "developer liquid" generally refers to the liquid applied to an imaging substrate such as photoreceptor 16 to develop a latent image. The "developer liquid" may comprise both toner particles and a carrier liquid in which the toner particles are dispersed. A suitable carrier liquid may comprise, for example, hydrocarbon solvents such as NORPAR or ISOPAR solvents commercially available from Exxon. An example of a preferred developer liquid is disclosed, for example, in copending and commonly assigned U.S. patent application Ser. No. 08/536,856, filed Sep. 29, 1995, entitled "LIQUID INK USING A GEL ORGANOSOL." The entire content of the above-referenced patent application is incorporated herein by reference.

The development roller 15 can be made, for example, from stainless steel. Each of development stations 36, 38, 40, 42 may include means for engaging development roller 15 in proximity with photoreceptor 16 to develop the appropriate latent image in an imaging region of the photoreceptor. A suitable engaging means may comprise, for example, any of a variety of camming or gear-driven mechanisms configured to move one or both of development roller 15 and photoreceptor 16 relative to one another. During engagement, development roller 15 is positioned a short distance from the surface of photoreceptor 16, forming a gap. In addition, development roller 15 is moved to travel in first direction 48 by, for example, activating a motor coupled to a rotor shaft associated with the development roller. The development roller 15 supplies a thin, uniform layer of developer liquid across the gap to photoreceptor 16.

To carry out the development of developer liquid, each of development stations 36, 38, 40, 42 further includes an electrical bias means (not shown) that creates an electric field between development roller 15 and photoreceptor 16. The electric field develops the latent image previously formed by the respective exposure station 28, 30, 32, 34 with the developer liquid applied by development roller 15. The electrical bias means may comprise a charging circuit that applies to the surface of development roller 15 a charge that induces the electric field. The development roller 15 applies developer liquid to photoreceptor 16 only long enough to develop an imaging region of the photoreceptor. Upon completion of an imaging cycle and movement of a nonimaging region of photoreceptor 16 past development roller 15, the application of developer liquid by the development roller is terminated. The application of developer liquid can be terminated by, for example, disengaging development roller 15 from proximity with photoreceptor 16, turning off the supply of developer liquid to the development roller, or obstructing the application of developer liquid from the development roller with a blade or other obstructing element. For termination of developer liquid application by disengagement, development roller 15 can be disengaged by reverse action of the same mechanism used for engagement.

A portion of the developer liquid can become back-plated on development roller 15. The back-plated developer liquid can alter the electrical properties of development roller 15, and can thereby affect uniformity of transfer of the developer liquid. To avoid nonuniformity, it may be desirable to incorporate in each of development stations 36, 38, 40, 42 a means for removing the back-plated developer liquid. A suitable means for removing the back-plated developer liquid from development roller 15 is disclosed, for example, in copending and commonly assigned U.S. patent application Ser. No. 08/538,193, filed Sep. 29, 1995, entitled "APPARATUS FOR REMOVAL OF DEVELOPER LIQUID FROM A DEVELOPMENT DEVICE." The entire content of the above-referenced patent application is incorporated herein by reference.

The development roller 15 in each development station can transfer an excessive amount of developer liquid to photoreceptor 16. The first squeegee roller 12 in each development station removes at least a portion of the excess developer liquid from photoreceptor 16 to partially dry the developed image. The first squeegee roller 12 is loaded against photoreceptor 16 with, for example, a spring mechanism to form a nip. The moving photoreceptor 16 drives first squeegee roller 12 by friction to rotate in the direction indicated by arrow 48. The rotating first squeegee roller 12 prevents excess developer liquid from passing through the nip and downstream with photoreceptor 16. The removal of excess developer liquid by first squeegee roller 12 results in partial drying of the developed image on photoreceptor 16.

The development roller 15 and first squeegee roller 12 can leave an excess volume of developer liquid on photoreceptor 16 upon termination of the application of developer liquid. The excess volume of developer liquid is sometimes referred to as a "drip line." To remove the "drip line," it may be desirable to further incorporate a squeegee apparatus such as that disclosed, for example, in U.S. patent application Ser. No. 08/536,521, filed Sep. 29, 1995, entitled "APPARATUS AND METHOD FOR REMOVING DEVELOPER LIQUID FROM AN IMAGING SUBSTRATE." The entire content of the above-referenced patent application is incorporated herein by reference.

The first squeegee roller 12 can be susceptible to axial deformation that can cause nonuniform pressure along the nip between the squeegee roller and the photoreceptor. To eliminate or reduce such nonuniformity, it may be desirable to incorporate a squeegee apparatus such as that disclosed, for example, in copending and commonly assigned U.S. patent application Ser. No. 08/537,128, filed Sep. 29, 1995, entitled "SQUEEGEE APPARATUS AND METHOD FOR REMOVING DEVELOPER LIQUID FROM A PHOTOCONDUCTOR AND FABRICATION METHOD. " The entire content of the above-referenced patent application is incorporated herein by reference.

The movement of photoreceptor 16 takes the latent images in the imaging region past each of development stations 36, 38, 40, 42 for development with the differently colored developer liquids applied by development rollers 15. After development stations 36, 38, 40, 42 have developed each of the latent images formed by exposure stations 28, 30, 32, 34, the imaging region of the moving photoreceptor 16 encounters drying station 44. The drying station includes a heated roller 66 that forms a nip with belt roller 22. The heated roller 66 applies heat to photoreceptor 16 to dry the developer liquid applied by development stations 36, 38, 40, 42. An example of a suitable drying station is disclosed in copending and commonly assigned U.S. patent application Ser. No. 08/536,080, filed Sep. 29, 1995, entitled "DRYING METHOD AND APPARATUS FOR ELECTROPHOTOGRAPHY USING LIQUID TONERS."

The imaging region of photoreceptor 16 next arrives at transfer station 46. The transfer station 46 includes an intermediate transfer roller 68 that forms a nip with photoreceptor 16 over belt roller 18 and a heated pressure roller 70 that forms a nip with the intermediate transfer roller. The developer liquid on photoreceptor 16 transfers from the photoreceptor surface to intermediate transfer roller 68 by selective adhesion. The heated pressure roller 70 serves to transfer the image on intermediate transfer roller 68 to an output substrate 72 by application of pressure and/or heat to the output substrate. The output substrate 72 may comprise, for example, paper or film. In this manner, transfer station 46 forms a visible representation of the original multi-color image on output substrate 72. An example of a suitable transfer station is disclosed in copending and commonly assigned U.S. patent application Ser. No. 08/536,687, filed Sep. 29, 1995, entitled "METHOD AND APPARATUS HAVING IMPROVED IMAGE TRANSFER CHARACTERISTICS FOR PRODUCING AN IMAGE ON PLAIN PAPER."

The operation of imaging system 10, as described above, generally is effective in producing a visible representation of an original multi-color image. However, the quality of the image remains a constant concern. The quality of the image can be degraded, in particular, by the passage of excess developer liquid to the downstream side of first squeegee roller 12, a problem sometimes referred to as "developer liquid wrap-around." The wrap-around developer liquid is undesirable because it can produce excess developer liquid in the margins of the printed page, adversely affecting image quality. The wrap-around developer liquid also can result in contamination of differently colored developer liquids and components within multi-color imaging system 10. Further, the wrap-around developer liquid cannot be reclaimed for use by imaging system 10, resulting in excessive developer liquid consumption.

Figure 2:
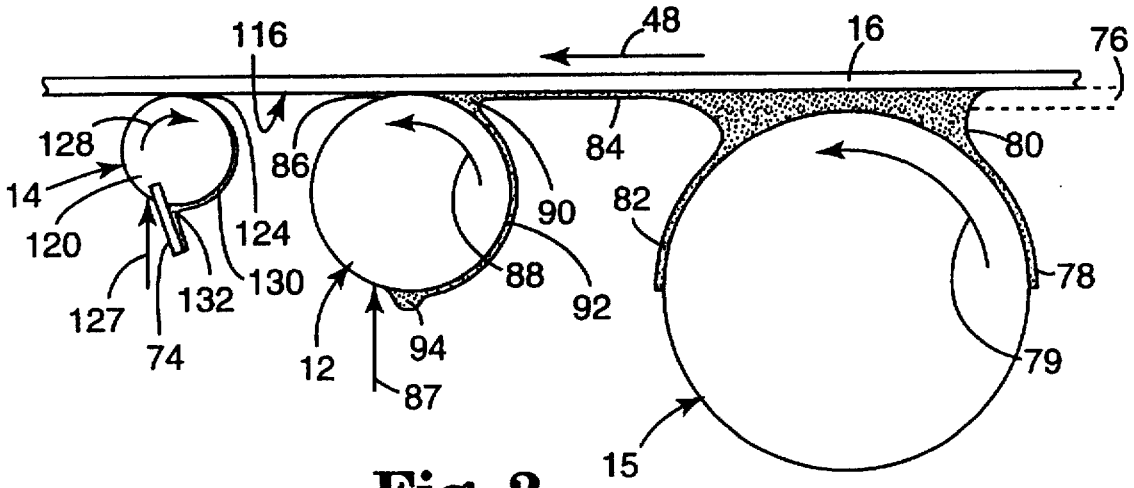
FIG. 2 is a side view of a portion of the imaging system of FIG. 1 incorporating an exemplary embodiment of a squeegee apparatus, in accordance with the present invention.

In accordance with the present invention, there is provided a squeegee apparatus and method that operate to remove from photoreceptor 16 the excess developer liquid caused by developer liquid wrap-around. FIGS. 2–6 together illustrate an exemplary embodiment of a squeegee apparatus, in accordance with the present invention. FIG. 2 is a side view of a portion of imaging system 10 incorporating an exemplary embodiment of a squeegee apparatus, in accordance with the present invention. As shown in FIG. 2, the squeegee apparatus includes first squeegee roller 12, second squeegee roller 14, and blade mechanism 74. In this exemplary embodiment, first squeegee roller 12 serves as a first developer liquid removal mechanism, whereas second squeegee roller 14 serves as a second developer liquid removal mechanism that removes wrap-around developer liquid from photoreceptor 16. The blade mechanism 74 serves to remove excess developer liquid from second squeegee roller 14 to keep the outer surface of the second squeegee roller substantially clean and prevent developer liquid wrap-around on second squeegee roller 14. Instead of blade mechanism 74, a rotating roller, belt, or vacuum device could be provide to keep second squeegee roller 14 clean.

In operation, as shown in FIG. 2, development roller 15 is positioned proximal to photoreceptor 16, forming a gap 76. A thin, uniform layer of developer liquid 78 is applied at an upstream side of development roller 15 as the development roller is rotated in the same direction as photoreceptor 16, as indicated by arrow 79. The developer liquid is transferred from development roller 15 to photoreceptor 16, as indicated by reference numeral 80, to develop the latent image. A portion of the developer liquid remains on development roller 15 and is carried down the downstream side of the development roller, as indicated by reference numeral 82. Another portion of the developer liquid is transferred to photoreceptor 16, however, and carried downstream with the developed image to first squeegee roller 12, as indicated by reference numeral 84.

The first squeegee roller 12 is loaded against photoreceptor 16 to form a nip 86, as indicated by arrow 87. The first squeegee roller 12 comprises an elastomeric material mounted about a rigid core. The core forms part of a shaft having first and second ends supported in bearing mounts. A loading means may be applied to the bearing mounts to load squeegee roller 12 against photoreceptor 16. The loading means may comprise, for example, a spring mechanism. A camming or gear-driven mechanism can be used to move first squeegee roller 12, along with the loading means, in and out of proximity with photoreceptor 16. The first squeegee roller 12 is passively driven by frictional contact with the moving photoreceptor 16. Consequently, first squeegee roller 12 moves in the same direction of movement as photoreceptor 16, as indicated by arrow 88.

As the region of photoreceptor 16 carrying the developed image encounters nip 86, first squeegee roller 12 removes a portion of excess developer liquid from the photoreceptor, serving to partially dry and film form the developer liquid remaining on photoreceptor 16 to facilitate transfer of the developed image. The excess developer liquid removed from photoreceptor 16 forms a holdup volume 90 at the upstream side of nip 86 and first squeegee roller 12. A balance between viscous forces and gravity forces determines the maximum amount of liquid in holdup volume 90. When holdup volume 90 has reached its maximum, any additional developer liquid entering the holdup volume results in liquid running down the upstream side of first squeegee roller 12, as indicated by reference numeral 92. The developer liquid running down the upstream side of squeegee roller 12 accumulates in a drip volume 94 that drips into developer liquid recovery reservoir 58 for addition to the developer liquid supply of imaging system 10.

Figure 3:
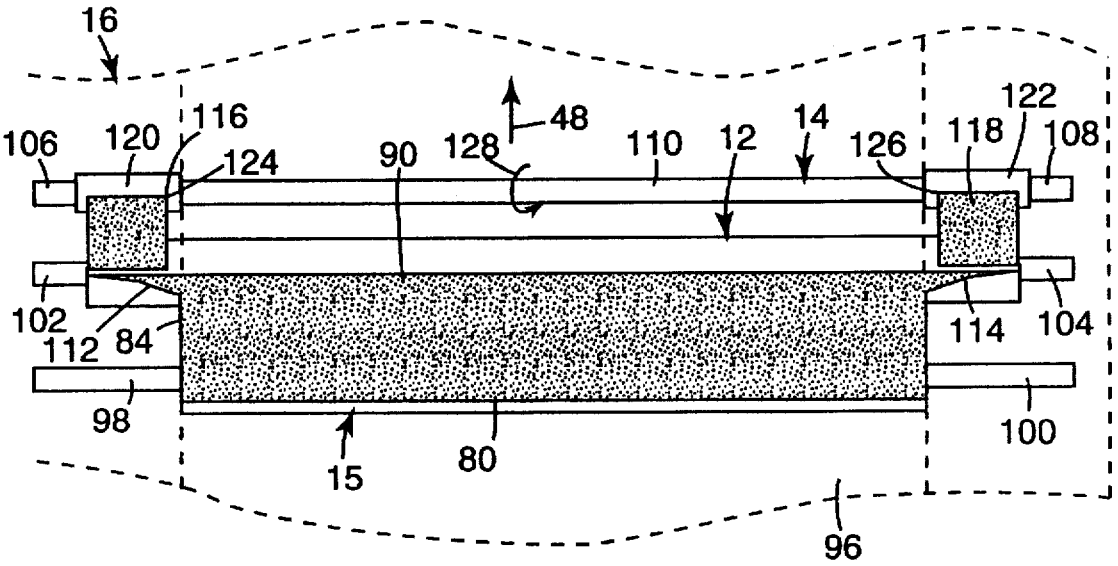
FIG. 3 is a top plan view of the squeegee apparatus shown in FIG. 2.

FIG. 3 is a top plan view of the squeegee apparatus shown in FIG. 2. As shown in FIG. 3, development roller 15, first squeegee roller 12, and second squeegee roller 14 are positioned in sequence along an imaging region 96 of photoreceptor 16 in the direction of movement indicated by arrow 48. As further shown in FIG. 3, development roller 15 includes shaft ends 98, 100, first squeegee roller 12 includes shaft ends 102, 104, and second squeegee roller 14 includes shaft ends 106, 108, and central shaft section 110. The first squeegee roller 12 generally is effective in removing excess developer liquid from photoreceptor 16. However, the amount of developer liquid in hold-up volume 90 of the squeegee roller nip 86 can become excessive, leading to the developer liquid "wrap-around" problem, as illustrated by FIG. 3.

The developer liquid wrap-around problem is caused, in part, by forces in nip 86 that act to draw the developer liquid from holdup volume 90 laterally outward toward opposite ends of first squeegee roller 12. In FIG. 3, the lateral movement of the developer liquid is indicated by reference numerals 112, 114. As the imaging sequence progresses, the developer liquid reaches the dry end regions and is sucked, or "wrapped," around first squeegee roller 12 to the downstream side, as indicated by reference numerals 116, 118. The wrap-around developer liquid 116, 118 creates bands of liquid on the downstream side of first squeegee roller 12. The first squeegee roller 12 transfers the bands of liquid to photoreceptor 16. If left unchecked, wrap-around developer liquid 116, 118 can be carried downstream with photoreceptor 16.

Figure 4:
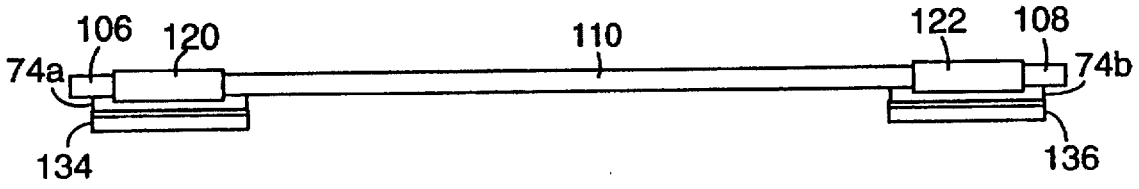
FIG. 4 is a front view of a squeegee roller forming part of a squeegee apparatus, in accordance with the present invention.

The second squeegee roller 14 serves as a second developer liquid removal mechanism that removes wrap-around developer liquid 116, 118 from photoreceptor 16, in accordance with the present invention. FIG. 4 is a front view of second squeegee roller 14, in accordance with the present invention. As shown in FIGS. 3 and 4, second squeegee roller 14 may include a first squeegee section 120 and a second squeegee section 122 mounted about common shaft 110. The first and second squeegee sections 120, 122 may comprise an elastomeric material such as polyurethane or nitrile, for example, mounted about rigid core sections on shaft 110. The first squeegee section 120 is mounted adjacent shaft end 106 and second squeegee section 122 is mounted adjacent shaft end 108. The second squeegee roller 14 is mounted at a position adjacent a downstream side of first squeegee roller 12.

The first squeegee section 120 and second squeegee section 122 are lightly loaded against photoreceptor 16 to make intimate contact with the photoreceptor, forming nips 124, 126, as indicated by arrow 127. The first squeegee section 120 and second squeegee section 122 need only interfere with the surface of photoreceptor 16 to remove the wrap-around developer liquid. As with first squeegee roller 12, shaft ends 106, 108 of second squeegee roller 14 can be mounted in bearing mounts, and loaded against photoreceptor 16 with a loading means such as a spring loading mechanism. In addition, a camming or gear-driven mechanism can be provided to move second squeegee roller 14 in and out of proximity with photoreceptor 16. The first squeegee roller 12 and second squeegee roller 14 can be loaded against photoreceptor 16 with the same loading means. In this case, second squeegee roller 14 could be mounted in a fixed relationship with first squeegee roller 12, eliminating the need for spring loading mechanism for the second squeegee roller.

A drive mechanism can be coupled to either of shaft ends 106, 108. The drive mechanism drives second squeegee roller 14 in a direction opposite to the direction of movement of photoreceptor 16, as indicated by arrow 128. The drive mechanism may comprise, for example, a motor or a belt or gear transmitting rotational force from a motor. The reverse operation of second squeegee roller 14 enables first squeegee section 120 and second squeegee section 122 to remove wrap-around developer liquid 116, 118, respectively, from photoreceptor 16 and carry the wrap-around developer liquid downward, as indicated by reference numeral 130 in FIG. 2. The first and second squeegee sections 120, 122 preferably are positioned slightly outside of imaging region 96. If first and second squeegee sections 120, 122 were positioned inside imaging region 96, the reverse operation of the squeegee sections could scrape away portions of developer liquid forming the developed image, significantly degrading image quality.

A loading force of approximately 0.5 kilograms, for example, applied to each of shaft ends 106, 108 has been observed to provide effective developer liquid removal during movement of second squeegee roller 14 in the direction indicated by arrow 128. Effective developer liquid removal likely can be carried out with less loading force or more loading force applied to second squeegee roller 14. However, excessive loading force may produce excessive wear on the release layer of photoreceptor 16 and may make squeegee roller 14 more difficult to drive. The rate at which the developer liquid can be removed from photoreceptor 16 is generally a function of the velocity ratio of the photoreceptor surface to the surfaces of first and second squeegee sections 120, 122, the length of the first and second squeegee sections, and the diameter of the first and second squeegee sections. The developer liquid removal rate also may depend on the surface characteristics of the material forming first and second squeegee sections 120, 122 and the fluid characteristics of the developer liquid.

As an example, if first and second squeegee sections 120, 122 having an outer Nitrile layer of approximately 50 to 60 durometer Shore A, a diameter of approximately 1.0 centimeters, and a length of approximately 3.2 centimeters, are driven in direction 128 at approximately 5.1 centimeters per second, and loaded against photoreceptor 16 moving in first direction 48 at approximately 7.6 centimeters per second with a loading force of approximately 0.3 to 0.7 kilograms applied at each of shaft ends 106, 108, adequate removal of wrap-around developer liquid from the surface of the photoreceptor can be expected.

Figure 5:
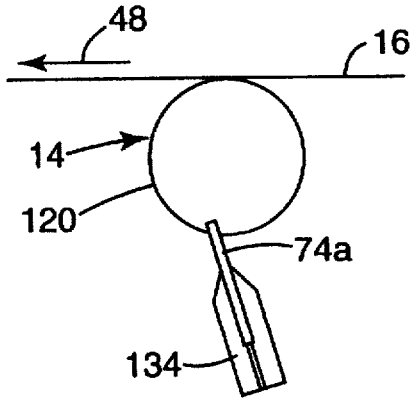
FIG. 5 is a side view of the squeegee roller shown in FIG. 4.
Figure 6:
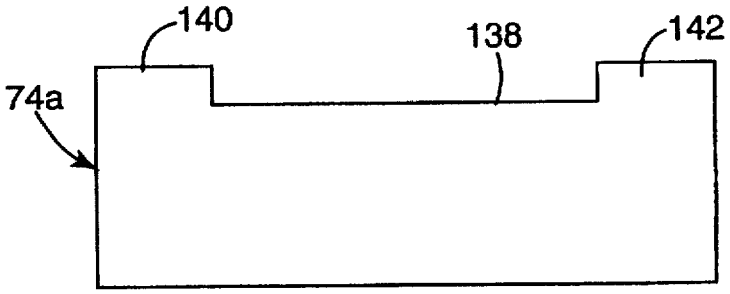
FIG. 6 is a front view of a portion of a blade for cleaning the squeegee roller shown in FIG. 4.

The developer liquid 130 carried downward by first squeegee section 120 and second squeegee section 122 can be removed by blade mechanism 74. The developer liquid removed by blade mechanism 74 can be incorporated into developer liquid recovery reservoir 58 for reintroduction into the developer liquid supply of imaging system 10. The blade mechanism 74 keeps the outer surfaces of first and second squeegee sections 120, 122 clean for continued removal of wrap-around developer liquid from photoreceptor 16. The incorporation of blade mechanism 74 is important in maintaining the developer liquid removal rate of first and second squeegee sections 120, 122 over an extended period of time. FIGS. 4–6 further illustrate blade mechanism 74. FIG. 5 is a side view of second squeegee roller 14 with blade mechanism 74. As shown in FIG. 4, for example, blade mechanism 74 may comprise a first blade member **74*a* mounted to remove developer liquid from first squeegee section 120 and a second blade member 74*b* to remove developer liquid from second squeegee section 122. With reference to FIGS. 4 and 5, first blade member 74*a* is positioned in a blade mount 134. Similarly, with reference to FIG. 4, second blade member 74*b* is positioned in a blade mount 136. The blade members 74*a*, 74*b* are mounted to extend along first and second squeegee sections 120, 122 in a trailing mode in the direction 128 of rotation of second squeegee roller 14**.

FIG. 6 is a front view of blade member **74*a* of FIG. 4. The blade members 74*a*, 74*b* provide first and second squeegee section 120, 122 with clean surfaces for removal of additional developer liquid from photoreceptor 16 in the next revolution of second squeegee roller 14. Thus, blade members 74*a*, 74*b* greatly enhance the ability of second squeegee roller 14 to remove excess developer liquid from photoreceptor 16. The blade members 74*a*, 74*b* should maintain uniform contact pressure across the entire lateral width of first and second squeegee sections 120, 122, respectively. Thus, blade members 74*a*, 74*b* preferably are made of a material selected so as to avoid warping or swelling. In particular, blade members 74a, 74b preferably comprise an elastomeric material for providing uniform contact pressure with first and second squeegee sections 120, 122, respectively. The blade members 74a, 74b also should be chemically inert to the developer liquid removed from second squeegee roller 14. An example of a suitable material for forming blade members 74a,, 74b** is fluoroelastomer FC 2174, available from Minnesota Mining & Manufacturing Company ("3M") of St. Paul, Minn.

To avoid the possibility of a secondary developer liquid wrap-around occurring at the nips created by contact of squeegee sections 120, 122 and blade members 74a, 74b, respectively, the blade members preferably are formed to extend upward along both ends of the squeegee section. As shown in FIG. 6, for example, blade member 74a includes a cut-out section 138 and end sections 140, 142. The cut-out section 138 makes contact with the outer circumferential surface of first squeegee section 120 to remove developer liquid from the first squeegee section. The end sections 140, 142 extend upward and make contact with the ends of first squeegee section 120 to prevent lateral movement of developer liquid out of the nip formed between the first squeegee section and cut-out section 138. The blade member 74a thereby prevents secondary wrap-around of developer liquid from the blade member back to the ends of first squeegee section 120.

Having described the exemplary embodiments of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A squeegee apparatus for removing excess developer liquid from an imaging substrate, the squeegee apparatus comprising:

a first developer liquid removal mechanism including a squeegee roller, and means for loading the squeegee roller against the imaging substrate, the squeegee roller removing the excess developer liquid from the imaging substrate at an upstream side of the squeegee roller relative to a direction of movement of the imaging substrate, wherein a portion of the excess developer liquid passes to a downstream side of the squeegee roller, the portion of the excess developer liquid being transferred from the squeegee roller to the imaging substrate; and a second developer liquid removal mechanism for removing from the imaging substrate the portion of the excess developer liquid transferred from the squeegee roller, wherein the second developer liquid removal mechanism includes a first sub-mechanism positioned to remove from the imaging substrate the portion of the excess developer liquid transferred from the squeegee roller at a first end of the squeegee roller, and a second sub-mechanism positioned to remove from the imaging substrate the portion of the excess developer liquid transferred from the squeegee roller at a second end of the squeegee roller.

2. The squeegee apparatus of claim 1, further comprising means for loading the first sub-mechanism and the second sub-mechanism against the imaging substrate at a position adjacent the downstream side of the first squeegee roller.

3. The squeegee apparatus of claim 1, wherein the squeegee roller is a first squeegee roller, the second developer liquid removal mechanism comprises a second squeegee roller, the first sub-mechanism includes a first squeegee section of the second squeegee roller, and the second sub-mechanism includes a second squeegee section of the second squeegee roller, the first and second squeegee sections being mounted about a common roller shaft, the first squeegee section being positioned to remove from the imaging substrate the portion of the excess developer liquid transferred from the first squeegee roller at the first end of the first squeegee roller, and the second squeegee section being positioned to remove from the imaging substrate the portion of the excess developer liquid transferred from the first squeegee roller at the second end of the first squeegee roller.

4. The squeegee apparatus of claim 3, wherein the second developer liquid removal mechanism further includes means for removing a portion of the excess developer liquid from the first squeegee section and the second squeegee section.

5. The squeegee apparatus of claim 3, wherein each of the first squeegee section and the second squeegee section is positioned outside of an imaging region of the imaging substrate.

6. The squeegee apparatus of claim 3, wherein the second developer liquid removal mechanism further includes a drive mechanism for driving the roller shaft of the second squeegee roller in a direction opposite to the direction of movement of the imaging substrate.

7. The squeegee apparatus of claim 6, wherein the second developer liquid removal mechanism further includes means for removing a portion of the excess developer liquid from the first squeegee section and the second squeegee section.

8. The squeegee apparatus of claim 6, wherein each of the first squeegee section and the second squeegee section is positioned outside of an imaging region of the imaging substrate.

9. The squeegee apparatus of claim 1, wherein the imaging substrate comprises a photoreceptor.

10. A squeegee apparatus for removing excess developer liquid from an imaging substrate, the squeegee apparatus comprising:

a first squeegee roller;

means for loading the first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate;

a second squeegee roller;

means for loading the second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate;

a drive mechanism for driving the second squeegee roller in a direction opposite to the direction of movement of the imaging substrate; and means for removing a portion of the excess developer liquid from the first squeegee section and the second squeegee section.

11. The squeegee apparatus of claim 10, wherein the first squeegee section and the second squeegee section are mounted about a common roller shaft.

12. The squeegee apparatus of claim 10, wherein the means for removing a portion of the excess developer liquid from the first squeegee section and the second squeegee section comprises at least one blade.

13. The squeegee apparatus of claim 10, wherein the imaging substrate comprises a photoreceptor.

14. A squeegee method for removing excess developer liquid from an imaging substrate, the squeegee method comprising the steps of:

loading a first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate;

loading a second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate;

driving the second squeegee roller in a direction opposite to the direction of movement of the imaging substrate; and removing a portion of the excess developer liquid from the first squeegee section and the second squeegee section.

15. The squeegee method of claim 14, wherein the first squeegee section and the second squeegee section are mounted about a common roller shaft.

16. The squeegee method of claim 14, wherein the step of removing a portion of the excess developer liquid from the first squeegee section and the second squeegee section comprises loading at least one blade against the first squeegee section and the second squeegee section.

17. The squeegee method of claim 16, wherein the imaging substrate comprises a photoreceptor.

18. A liquid electrographic imaging system comprising:

an imaging substrate;

means for moving the imaging substrate in a first direction;

means for forming a latent electrostatic image on an imaging region of the imaging substrate;

a development station for delivering developer liquid to the imaging region of the imaging substrate to develop the latent electrostatic image;

a squeegee apparatus for removing excess developer liquid from the imaging substrate, the squeegee apparatus comprising:

a first developer liquid removal mechanism including a squeegee roller, and means for loading the squeegee roller against the imaging substrate, the squeegee roller removing the excess developer liquid from the imaging substrate at an upstream side of the squeegee roller relative to a direction of movement of the imaging substrate, wherein a portion of the excess developer liquid passes to a downstream side of the squeegee roller, the portion of the excess developer liquid being transferred from the squeegee roller to the imaging substrate, and a second developer liquid removal mechanism for removing from the imaging substrate the portion of the excess developer liquid transferred from the squeegee roller, wherein the second developer liquid removal mechanism includes a first sub-mechanism positioned to remove from the imaging substrate the portion of the excess developer liquid transferred from the first squeegee roller at a first end of the first squeegee roller, and a second sub-mechanism positioned to remove from the imaging substrate the portion of the excess developer liquid transferred from the first squeegee roller at a second end of the first squeegee roller; and means for transferring the developer liquid remaining on the imaging region of the imaging substrate to an output substrate, thereby forming a visible representation of an image.

19. The imaging system of claim 18, further comprising means for loading the first sub-mechanism and the second sub-mechanism against the imaging substrate at a position adjacent the downstream side of the first squeegee roller.

20. The imaging system of claim 19, wherein the squeegee roller is a first squeegee roller, the second developer liquid removal mechanism comprises a second squeegee roller, the first sub-mechanism includes a first squeegee section of the second squeegee roller, and the second sub-mechanism includes a second squeegee section of the second squeegee roller, the first and second squeegee sections being mounted about a common roller shaft, the first squeegee section being positioned to remove from the imaging substrate the portion of the excess developer liquid transferred from the first squeegee roller at the first end of the first squeegee roller, and the second squeegee section being positioned to remove from the imaging substrate the portion of the excess developer liquid transferred from the first squeegee roller at the second end of the first squeegee roller.

21. The imaging system of claim 20, wherein the second developer liquid removal mechanism further includes means for removing a portion of the excess developer liquid from the first squeegee section and the second squeegee section.

22. The imaging system of claim 20, wherein each of the first squeegee section and the second squeegee section is positioned outside of an imaging region of the imaging substrate.

23. The imaging system of claim 22, wherein the second developer liquid removal mechanism further includes means for removing a portion of the excess developer liquid from the first squeegee section and the second squeegee section.

24. The imaging system of claim 22, wherein each of the first squeegee section and the second squeegee section is positioned outside of an imaging region of the imaging substrate.

25. The imaging system of claim 20, wherein the second developer liquid removal mechanism further includes a drive mechanism for driving the roller shaft of the second squeegee roller in a direction opposite to the direction of movement of the imaging substrate.

26. The imaging system of claim 18, wherein the imaging system is a liquid electrophotographic imaging system and the imaging substrate comprises a photoreceptor.

27. A liquid electrographic imaging system comprising:

an imaging substrate;

means for moving the imaging substrate in a first direction;

means for forming a latent electrostatic image on an imaging region of the imaging substrate;

a development station for delivering developer liquid to the imaging region of the imaging substrate to develop the latent electrostatic image;

a squeegee apparatus for removing excess developer liquid from the imaging substrate, the squeegee apparatus comprising:

a first squeegee roller, means for loading the first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate, a second squeegee roller, means for loading the second squeegee roller against the imaging substrate at a position adjacent the downstream side of the first squeegee roller, the second squeegee roller removing from the imaging substrate the portion of the excess developer liquid transferred from the squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller, wherein each of the first and second squeegee sections is positioned outside of an imaging region of the imaging substrate, a drive mechanism for driving the second squeegee roller in a direction opposite to the direction of movement of the imaging substrate, and means for removing a portion of the excess developer liquid from the first squeegee section and the second squeegee section; and means for transferring the developer liquid remaining on the imaging region of the imaging substrate to an output substrate, thereby forming a visible representation of an image.

28. The imaging system of claim 27, wherein the first squeegee section and the second squeegee section are mounted about a common roller shaft.

29. The imaging system of claim 28, wherein the means for removing a portion of the excess developer liquid from the first squeegee section and the second squeegee section comprises at least one blade.

30. The imaging system of claim 27, wherein the imaging system is a liquid electrophotographic imaging system and the imaging substrate comprises a photoreceptor.

31. A squeegee apparatus for removing excess developer liquid from an imaging substrate, the squeegee apparatus comprising:

a first squeegee roller;

a device for loading the first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate;

a second squeegee roller;

a device for loading the second squeegee roller against the imaging substrate at a position adjacent the downstream side of the first squeegee roller, the second squeegee roller removing from the imaging substrate the portion of the excess developer liquid transferred from the first squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller.

32. The squeegee apparatus of claim 31, wherein each of the first and second squeegee sections is positioned outside of an imaging region of the imaging substrate.

33. The squeegee apparatus of claim 31, further comprising a drive mechanism for driving the second squeegee roller in a direction opposite to the direction of movement of the imaging substrate.

34. The squeegee apparatus of claim 31, further comprising a device for removing a portion of the excess developer liquid from the first squeegee section and the second squeegee section.

35. The squeegee apparatus of claim 34, wherein the device for removing a portion of the excess developer liquid from the first squeegee section and the second squeegee section comprises at least one blade.

36. The squeegee apparatus of claim 31, wherein the first squeegee section and the second squeegee section are mounted about a common roller shaft.

37. The squeegee apparatus of claim 31, wherein the imaging substrate comprises a photoreceptor.

38. A squeegee method for removing excess developer liquid from an imaging substrate, the squeegee method comprising the steps of:

loading a first squeegee roller against the imaging substrate, the first squeegee roller removing the excess developer liquid from the imaging substrate at an upstream side of the first squeegee roller relative to a direction of movement of the imaging substrate, wherein a portion of the excess developer liquid passes to a downstream side of the first squeegee roller, the portion of the excess developer liquid being transferred from the first squeegee roller to the imaging substrate;

loading a second squeegee roller against the imaging substrate at a position adjacent the downstream side of the first squeegee roller, the second squeegee roller removing from the imaging substrate the portion of the excess developer liquid transferred from the first squeegee roller, the second squeegee roller including a first squeegee section positioned to remove the portion of the excess developer liquid at a first end of the first squeegee roller and a second squeegee section positioned to remove the portion of the excess developer liquid at a second end of the first squeegee roller.

39. The squeegee method of claim 38, wherein each of the first and second squeegee sections is positioned outside of an imaging region of the imaging substrate.

40. The squeegee method of claim 38, further comprising the step of driving the second squeegee roller in a direction opposite to the direction of movement of the imaging substrate.

41. The squeegee method of claim 38, further comprising the step of removing a portion of the excess developer liquid from the first squeegee section and the second squeegee section.

42. The squeegee method of claim 41, wherein the step of removing a portion of the excess developer liquid from the first squeegee section and the second squeegee section comprises loading at least one blade against the first squeegee section and the second squeegee section.

43. The squeegee method of claim 38, wherein the first squeegee section and the second squeegee section are mounted about a common roller shaft.

44. The squeegee apparatus of claim 38, wherein the imaging substrate comprises a photoreceptor.

* * * * *